US007293444B2

(12) United States Patent
Hacker et al.

(10) Patent No.: US 7,293,444 B2
(45) Date of Patent: Nov. 13, 2007

(54) BENDING APPARATUS FOR ROD-SHAPED AND TUBULAR WORKPIECES

(75) Inventors: Frank Hacker, Riederich (DE); Werner Maier, Reutlingen (DE); Patrik Schlund, Reutlingen (DE); Jürgen Wolf, Walddorfhäslach (DE); Dietmar Sautter, Lichtenstein (DE)

(73) Assignee: WAFIOS Aktiengesellschaft, Reutlingen (DE)

( * ) Notice: Subject to any disclaimer, the term of this patent is extended or adjusted under 35 U.S.C. 154(b) by 0 days.

(21) Appl. No.: 11/369,256

(22) Filed: Mar. 7, 2006

(65) Prior Publication Data

US 2006/0201219 A1 Sep. 14, 2006

(30) Foreign Application Priority Data

Mar. 8, 2005 (EP) ..... 05005045

(51) Int. Cl.
*B21D 7/03* (2006.01)

(52) U.S. Cl. ..... 72/158; 72/159; 72/157

(58) Field of Classification Search ..... 72/158, 72/159, 154, 155, 150, 149, 157
See application file for complete search history.

(56) References Cited

U.S. PATENT DOCUMENTS 3,410,125 A 11/1968 Schmidt
4,380,920 A 4/1983 Coop, Sr. et al.
5,222,552 A 6/1993 Schuchert
5,495,740 A 3/1996 Schwarze
5,819,574 A * 10/1998 Yogo ..... 72/155
7,140,224 B2 * 11/2006 Luo et al. ..... 72/369

FOREIGN PATENT DOCUMENTS

| | | |
|---|---|---|
| DE | 201 18 444 U1 | 3/2002 |
| DE | 696 24 723 T2 | 3/2003 |
| EP | 0 852 522 B1 | 6/2002 |
| GB | 943918 | 12/1963 |

* cited by examiner

*Primary Examiner*—Derris H. Banks
*Assistant Examiner*—Debra M Wolfe
(74) *Attorney, Agent, or Firm*—Patterson, Thuente, Skaar & Christensen, P.A.

(57) ABSTRACT

A bending apparatus for rod-shaped and tubular workpieces, includes a rotatable bending mandrel with a bending groove is provided with a wrinkle smoothener, which immediately precedes the bending mandrel, and two sliding jaws. In order to change the bending direction around the bending mandrel, the sliding jaws can be moved to the other side thereof. In doing so, the sliding jaw on the side of the bending mandrel is arranged freely rotatable on a support axis, which extends parallel to the axis of rotation of the bending mandrel and whose position relative to the bending mandrel can be shifted parallel to the feeding direction of the workpiece. The sliding jaw is provided such that the end of its forming groove facing towards the bending mandrel can be placed in contact with the bending groove by shifting the support axis and, thus, its forming groove tangentially joins said groove.

13 Claims, 6 Drawing Sheets

BENDING APPARATUS FOR ROD-SHAPED AND TUBULAR WORKPIECES

RELATED APPLICATION

The current application claims the benefit of priority to European Patent Application No. EP 05 005 045.9 filed on Mar. 8, 2005. Said application is incorporated by reference herein.

FIELD OF THE INVENTION

The invention relates to bending apparatus for rod-shaped and tubular workpieces, said apparatus comprising a displaceable bending head having arranged thereon a rotatable bending mandrel with a bending groove for contact with the workpiece to be bent as well as a clamping device, which is displaceable relative to the bending mandrel and concentrically rotatable relative thereto, for clamping the workpiece to be processed between said clamping apparatus and said bending mandrel, and said apparatus comprising a feeding device for the workpiece, wherein the bending apparatus is adapted for both right-hand bending and left-hand bending of the workpiece around the bending mandrel, and the workpiece can be made to contact the bending mandrel on one side thereof in a predetermined bending direction and on the other side thereof when changing the bending direction, wherein the bending head also carries a wrinkle smoothener, which—when viewed in the feeding direction of the workpiece—immediately precedes the bending mandrel and comprises two sliding jaws between which the workpiece is located and each of which is provided, on its side facing towards the workpiece, with a forming groove that is substantially complementary to the outer contour thereof, which groove can be made to contact the external surface of the workpiece, one sliding jaw being displaceable relative to the other sliding jaw perpendicular to the feeding direction of the workpiece and both sliding jaws being displaceable and/or rotatable, as is the clamping device, to the other side of the bending mandrel for changing the bending direction around the bending mandrel into a corresponding arrangement of its forming groove, which arrangement is mirror-inverted to a plane that extends through the axis of rotation of the bending mandrel and is parallel to the feeding direction of the workpiece. The invention further relates to a wrinkle-smoothener arrangement for use in such bending apparatus.

BACKGROUND OF THE INVENTION

Wrinkle smootheners are required for automated bending of tubes having small wall thicknesses and at the same time small bending radiuses, said smootheners preceding the bending mandrel when viewed in the feeding direction of the tube. If the tube is clamped, on the one hand, between the clamping device and the bending mandrel and is, moreover, received between the two sliding jaws of the wrinkle smoothener, it is not possible for the tube to yield in an uncontrolled manner on the internal radius side during the bending operation. This makes it possible to also bend thin-walled tubes having a small bending radius. Therefore, wrinkle smootheners are employed in tube bending so as to improve the bending result. However, the use of wrinkle smootheners is problematic in bending machines in which the bending head is stationary. This is because, in order to generate both left-hand and right-hand bends with such machines, it has to be possible to place the tube in contact on opposite sides of the central axis of the bending mandrel. However, if the bending process requires a wrinkle smoothener in both bending directions, there is the problem in these known machines that the wrinkle smoothener, since it is permanently attached to the machine body, has to be manually shifted and newly aligned when changing the bending direction. This means that an operator has to be present at the bending machine at all times, and therefore it has been attempted to limit the use of a wrinkle smoothener to only one bending direction. However, such limitations almost always turn out to be of great disadvantage to users of the bending machines.

A machine comprising such a wrinkle smoothener is known from DE 696 24 723 T2, wherein, for operation, the sliding jaws of the wrinkle smoothener are connected to each other and biased against each other by locking elements, which are mounted, longitudinally spaced apart, to the outer periphery of the sliding jaws.

In the arrangement described in U.S. Pat. No. 5,222,552 a wrinkle smoothener is provided with only one sliding jaw, however, which can only be made to unilaterally contact the workpiece on the side of the bending mandrel and is also securely mounted to the machine frame, but can be laterally folded away from the workpiece or onto it.

The wrinkle smoothener of DE 201 18 444 U1 is also securely attached to the machine frame.

Tube bending apparatus of the above-mentioned type has been known in the market for a short time, said apparatus being adapted for both right-hand bending and left-hand bending of a workpiece about a bending mandrel and employing a wrinkle smoothener which can be used in both bending directions. The wrinkle smoothener comprises two sliding jaws, one of which is displaceable towards the other. A sliding jaw which is laterally arranged on the bending tool—viewed relative to the workpiece—is mounted to a support which is mounted to the bending head such that, although it is concentrically rotatable relative to the bending mandrel, it is not movable towards the latter.

A specific problem common to all the aforementioned wrinkle smootheners is that, if the wrinkle smoothener or its forming groove is not aligned absolutely precisely, there may be a risk of edges deflecting, so that precise alignment of the wrinkle smoothener is of particular importance also with respect to its overall effectiveness. The operations to be carried out for this purpose, which always have to be effected anew, in particular also when refitting a wrinkle smoothener, have to be carried out with great precision and are time-consuming.

SUMMARY OF THE INVENTION

The invention is now directed to providing improved bending apparatus comprising a wrinkle smoothener of the above-mentioned type, which apparatus, while largely avoiding the disadvantages known from the prior art, enables very precise adjustment of the forming groove of the sliding jaw of the wrinkle smoothener on the side of the bending mandrel both with regard to the workpiece and with respect to its introduction into the forming groove of the bending mandrel in a particularly simple and quick manner and ensures automatic adjustment of the alignment relative to the workpiece also during on-going operation and even while changing the bending apparatus, and is further directed to proposing a wrinkle smoothener arrangement suitable for use in such bending apparatus which can be adapted to both bending directions.

According to the invention, bending apparatus for rod-shaped and tubular workpieces of the above-mentioned type is proposed, wherein the sliding jaw on the side of the bending mandrel is arranged on a supporting axis located parallel to the axis of rotation of the bending mandrel, on which supporting axis it is arranged so as to be freely rotatable and which is displaceable towards the bending mandrel and away from it parallel to the feeding direction of the workpiece, said sliding jaw being provided such that, by displacement of the supporting axis towards the bending mandrel, the end of its forming groove facing towards the bending mandrel can be made to contact the bending groove of the bending mandrel such that its forming groove is tangentially contiguous to that of the bending mandrel.

The bending apparatus according to the invention enables the use of the wrinkle smoothener construction provided therein for both left-hand bending and right-hand bending without having to refit it. When changing the bending direction, the individual elements forming the wrinkle smoothener can also be adapted jointly and automatically, together with the other elements of the apparatus that have to be adapted when changing the bending direction, which can even be effected by a program control without the presence of an operator, thus completely eliminating this particular big disadvantage of known bending machines, where the presence of an operator for re-fitting the wrinkle smoothener was required when changing the bending apparatus.

Since the sliding jaw of the wrinkle smoothener, which is located on the side of the bending mandrel (relative to the feeding direction of the workpiece), is freely rotatable on its supporting axis, thus effecting a kind of "floating support" for the wrinkle smoothener unit, the wrinkle smoothener independently and automatically adjusts the exact alignment position both relatively when contacting the workpiece and during displacement towards and contact with the bending mandrel, so that even during operation the correct alignment relative to the workpiece and to the bending mandrel is at the same time always automatically re-adjusted or maintained, respectively, when wear occurs. Preferably, the respective sliding jaw of the wrinkle smoothener is arranged on its supporting axis not only freely rotatable, but also freely movable in the axial direction of said axis (at least over a certain length of displacement), so that said sliding jaw, when it contacts the bending groove of the bending mandrel and laterally contacts the workpiece, can perform an aligning movement not only in the direction of rotation about its supporting axis, but also axially along the supporting axis, and thus can be made to contact the bending groove of the bending mandrel automatically in an optimal manner. This can be preferably improved also by making the diameter of the supporting axis somewhat smaller than the receiving bore of the sliding jaw, so that the sliding jaw can also assume an at least slight tilting position relative to the supporting axis.

But even in case only free rotation about the supporting axis is given, without free displaceability existing axially along it, or even without the possibility that a certain tilted position relative to it can be assumed, even then very good adjustment is still effected during contact both laterally against the workpiece and against the bending groove of the bending mandrel (in the region where the workpiece is fed into the groove).

Due to the fact that in the bending apparatus according to the invention the supporting axis of the sliding jaw of the wrinkle smoothener on the side of the bending mandrel is linearly displaceable towards the bending mandrel and away from it, respectively, and in a plane perpendicular to the bending axis (namely parallel to the feeding direction of the workpiece), the end region of the forming groove of said sliding jaw facing towards the bending mandrel can be displaced towards the bending mandrel absolutely exactly until it is so close that the forming groove of the sliding jaw in its end region passes into the bending groove of the bending mandrel tangentially to said groove and can thus be made to contact the bending groove of the bending mandrel. Accordingly, said end region of the aforementioned sliding jaw with its forming groove is provided such that when being contacted, it can be introduced into the bending groove with an exact fit and is thus adapted to the shape of the groove, thus ensuring great precision of alignment of the workpiece to be bent, when the latter passes into the bending groove of the bending mandrel, during operation of the apparatus. Moreover, wear at the tip of this sliding jaw of the wrinkle smoothener is kept very low. If, in an advantageous embodiment of the invention, the respective sliding jaw of the wrinkle smoothener is constantly subjected to a certain bias in a direction towards the bending mandrel, which bias can be applied mechanically (e.g. by a biasing spring) or also hydraulically or in any other suitable manner, it can also be ensured that even with a certain abrasion of the parts of the sliding jaw and of the bending mandrel in engagement with each other during operation of the bending apparatus, a corresponding re-adjustment is effected immediately and automatically in each case so that these parts always contact each other with a precise fit.

Due to the displaceability of the two sliding jaws towards one another and away from each other, in the bending apparatus according to the invention precise lateral contact of these sliding jaws on both sides of the workpiece to be treated and thus also, if desired, a desired mutual contact pressure can always be ensured automatically, again mechanically, hydraulically or pneumatically, without requiring the sliding jaws of the wrinkle smoothener located opposite each other to be tightened and fixed relative to each other, as is the case with some of the known bending apparatus, or even—as in other known cases—without having to lock the individual sliding jaws in their engagement position on the machine frame.

The structure of the bending apparatus according to the invention, by the interaction of the "floating" support of the sliding jaw of the wrinkle smoothener on the side of the bending mandrel and its displaceability towards the bending mandrel, achieves a quick as well as automatically maintainable, virtually optimal adaptation of the sliding jaw and its forming groove when contacting the workpiece and in the introducing region of the bending mandrel (with the end region of the sliding jaw protruding into it), so that the wrinkle smoothener provides excellent overall effectiveness.

In an advantageous embodiment of the bending apparatus according to the invention, the sliding jaw used as that which is displaceable towards the other sliding jaw and away from it is that which is located on the same side of the workpiece as the clamping device, because the space needed for the required displaceability on this side is not difficult to realize.

A further preferable embodiment of the bending apparatus according to the invention also consists in providing a control by which the displacement and/or rotation movements of the various constructive elements on the bending head, which are to be effected in order to change the bending direction, are initiated only after the bending head has been lowered so far that all of these elements are located below the workpiece clamped in the bending apparatus, which then allows to effect free displacement of these elements below the workpiece without interference from the workpiece.

In most cases, the wrinkle smoothener comprises sliding elements such that the sliding element on each side of the workpiece comprises a sliding jaw. However, it may also be preferred in certain cases, if the wrinkle smoothener comprises more than one, preferably two, sliding jaws arranged immediately following each other on at least one side of the workpiece. Thus, on the side of the workpiece on which the bending mandrel is located the wrinkle smoothener may comprise two sliding jaws arranged following each other in the feeding direction of the workpiece and mounted to a common support, which is freely rotatable about the supporting axis, said sliding jaws having shapes that are mirror-symmetric to each other on the common support in a plane which extends through the supporting axis and perpendicular to the feeding direction of the workpiece. When changing the bending direction in this embodiment, only a rotation of the respective support into a position which is mirror-symmetric to its initial position (relative to an axis which extends through the axis of rotation of the bending mandrel and parallel to the feeding direction of the workpiece) will be required, so that a sliding jaw designed in this manner immediately assumes the appropriate starting position for bending in the other bending direction.

Preferably, the support is thus also provided with a device allowing to alter or adjust the distance between the two sliding jaws mounted to the support.

In the bending apparatus according to the invention, the supporting axis is preferably arranged to be displaceable on a support ring, which is in turn arranged concentrically on the shaft of the bending mandrel, rotatable relative thereto, which shaft then allows to effect the corresponding rotary movements when changing the bending direction. Particularly preferably, the support ring is provided with a radially protruding portion on which the supporting shaft is displaceably held and which forms a radially outwardly open holding fork at its protruding end portion, said holding fork receiving a sliding block which is in turn rotatably arranged to a holding device that is movable perpendicular to the feeding direction of the workpiece. This results in a very space-saving but, on the whole, kinematically relatively simple overall arrangement, which allows both the linear relative movement of the supporting axis towards the bending mandrel (or away from it, respectively) and, at the same time, also a rotary movement to be performed by the protruding portion which holds the supporting shaft, by means of a holding device displaceable perpendicular to the feeding direction of the workpiece (via a sliding block which is rotatably mounted to said shaft and received in the holding fork of the protruding portion).

Advantageously, the supporting shaft is located on a carrier block which is in turn displaceable within a radially outwardly extending guide groove of the radially protruding portion of the support ring, which groove is provided above the holding fork and is closed at its radially outward end by a crossbar, in which an adjusting screw is rotatably arranged, said screw engaging the carrier block and allowing position adjustment of the support block in the guide groove. This makes it possible to effect very precise and exact initial setting or position setting of the supporting axis (and, thus, of the sliding jaw mounted to it).

In the above-described embodiment of the bending apparatus according to the invention, the holding device preferably comprises a supporting bridge, which is held on the bending head, is displaceable relative to the latter and is guided on linear rails, by means of which rails the lateral deflections for carrying out a rotary movement of the support ring can be performed.

Another preferable embodiment of the bending apparatus according to the invention also consists in that the sliding jaw located on the side of the clamping device comprises, on the side opposite its forming groove, another forming groove in mirror-symmetric arrangement relative to said forming groove with respect to a longitudinal center plane of said sliding jaw, which plane is parallel to the workpiece feeding direction and to the axis of rotation of the bending mandrel. Preferably, in order to change the bending direction, said sliding jaw is displaceable to the other side of the bending mandrel such that its further forming groove can be made to contact the workpiece there. Advantageously, it is connected to a drive unit on the side of the clamping device, via which drive unit it can be displaced both parallel to the feeding direction of the workpiece and in a direction perpendicular to it, towards the other side of the bending mandrel, in order to change the bending direction.

In another preferred embodiment of the bending apparatus according to the invention, all sliding jaws are located on a common carrier plate, on which the sliding jaw located on the same side of the workpiece as the clamping device is arranged so as to be displaceable both in a vertical direction towards the forming groove of the other sliding jaw and parallel to said groove, wherein in order to change the bending direction, said carrier plate with the sliding jaw carried by it can be pivoted about an axis of rotation which is parallel to the axis of rotation of the bending mandrel and is located in a plane which extends through the axis of rotation of the bending mandrel and parallel to the feeding direction of the workpiece.

The aforementioned embodiments allow a bending apparatus which also has a very compact structure, wherein the change in bending direction, including the corresponding positional shifts of the parts of the wrinkle smoothener, can be effected in a simple and rapid manner.

The invention further relates to a wrinkle smoothener arrangement, which is particularly suitable for use in one of the aforementioned bending apparatus according to the invention, wherein said bending apparatus for bar-shaped and tubular workpieces is provided with a bending mandrel which comprises a bending groove and is adapted for both right-hand bending and left-hand bending, the wrinkle smoothener arrangement according to the invention comprising two sliding jaws contacting the workpiece on two sides thereof and each of said sliding jaws comprising a forming groove contacting the workpiece, and at least one of said sliding jaws being displaceable towards the other as well as both sliding jaws being mountable to the bending apparatus such that, in order to change the bending direction, they can be moved around the bending mandrel in a plane extending through the axis of rotation of the bending mandrel and parallel to the feeding direction of the workpiece, into a mirror-inverted arrangement of their forming grooves, wherein according to the invention the sliding jaw provided for the arrangement on the side of the bending mandrel is arranged, freely rotatable, on a supporting axis which is located parallel to the axis of rotation of the bending mandrel, to which supporting axis an adjusting device is assigned, by means of which the position of the axis can be shifted towards the bending mandrel, until the sliding jaw contacts it, and away from it, said sliding jaw and its forming groove being provided such—when viewed in the longitudinal direction of the forming groove—that each one of its end portions can be made to contact the bending mandrel, if said jaw faces towards the bending mandrel, such that the end portion of the jaw's forming groove there is tangentially contiguous to the bending groove of the bending mandrel.

This wrinkle smoothener arrangement according to the invention can be used, in particular, in one of the above-described bending apparatuses according to the invention; independently thereof, however, it may also be used separately as a structural assembly which can be supplied as a re-fittable part of bending apparatus for rod-shaped and tubular workpieces and can be incorporated therein, so that such bending apparatus is then re-fittable to bending apparatus according to the invention, as described above.

Particularly advantageous embodiments of the wrinkle smoothener arrangement according to the invention result from the statements made above in connection with advantageous embodiments of the bending apparatus according to the invention with respect to the wrinkle smoothener arrangements used therein, to which reference is made here.

It is possible, by means of the wrinkle smoothener arrangement according to the invention, to equip known bending apparatuses which are adjustable for bilateral bending also with respect to the use of a single wrinkle smoothener arrangement, which is also adjustable to different bending directions.

BRIEF DESCRIPTION OF THE DRAWINGS

The invention is explained in more detail below, essentially by way of example, with reference to the drawings, wherein.

DETAILED DESCRIPTION OF THE INVENTION

Figure 1:
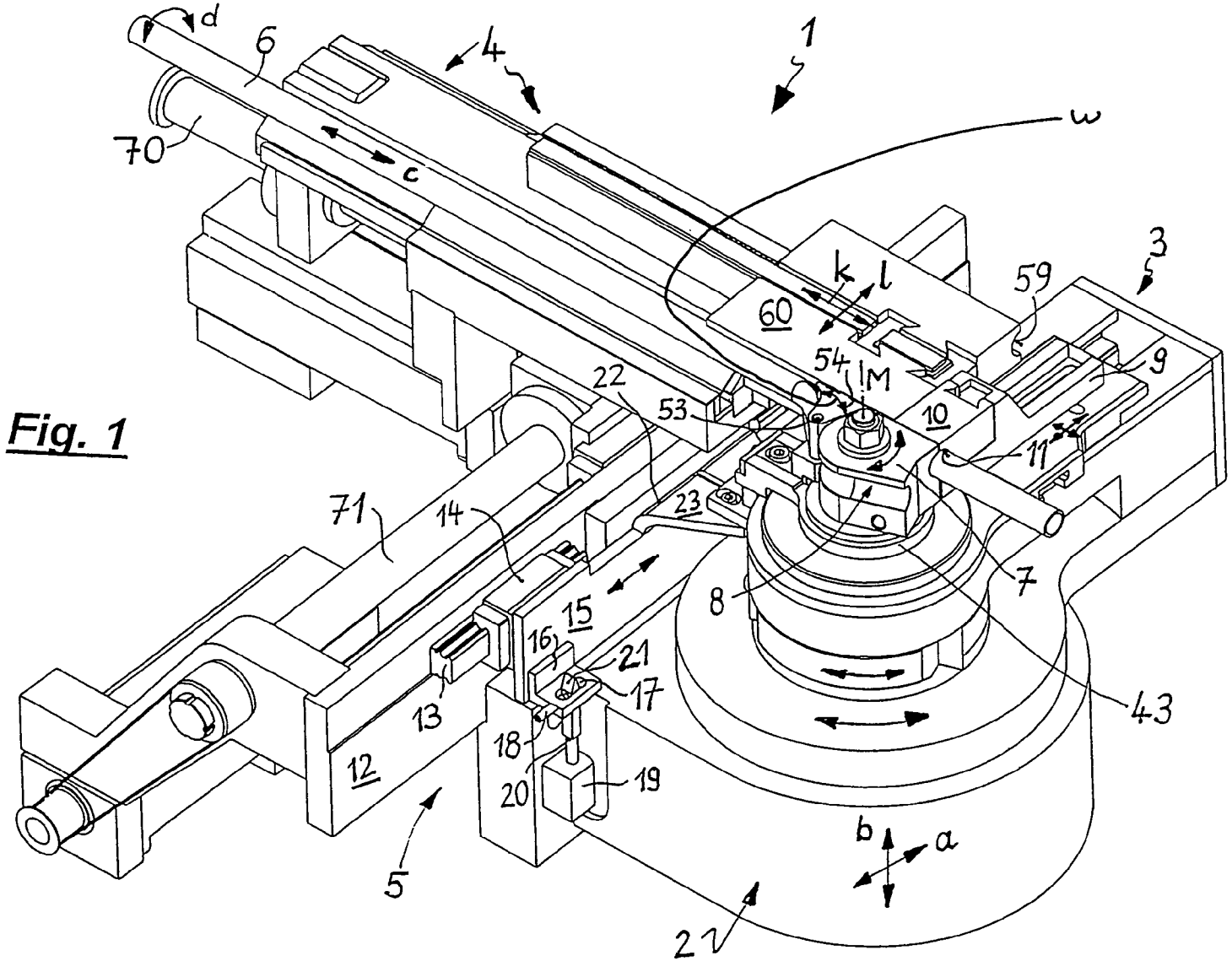
FIG. 1 shows an oblique perspective view of bending apparatus according to the invention, set for right-hand bending.
Figure 2:
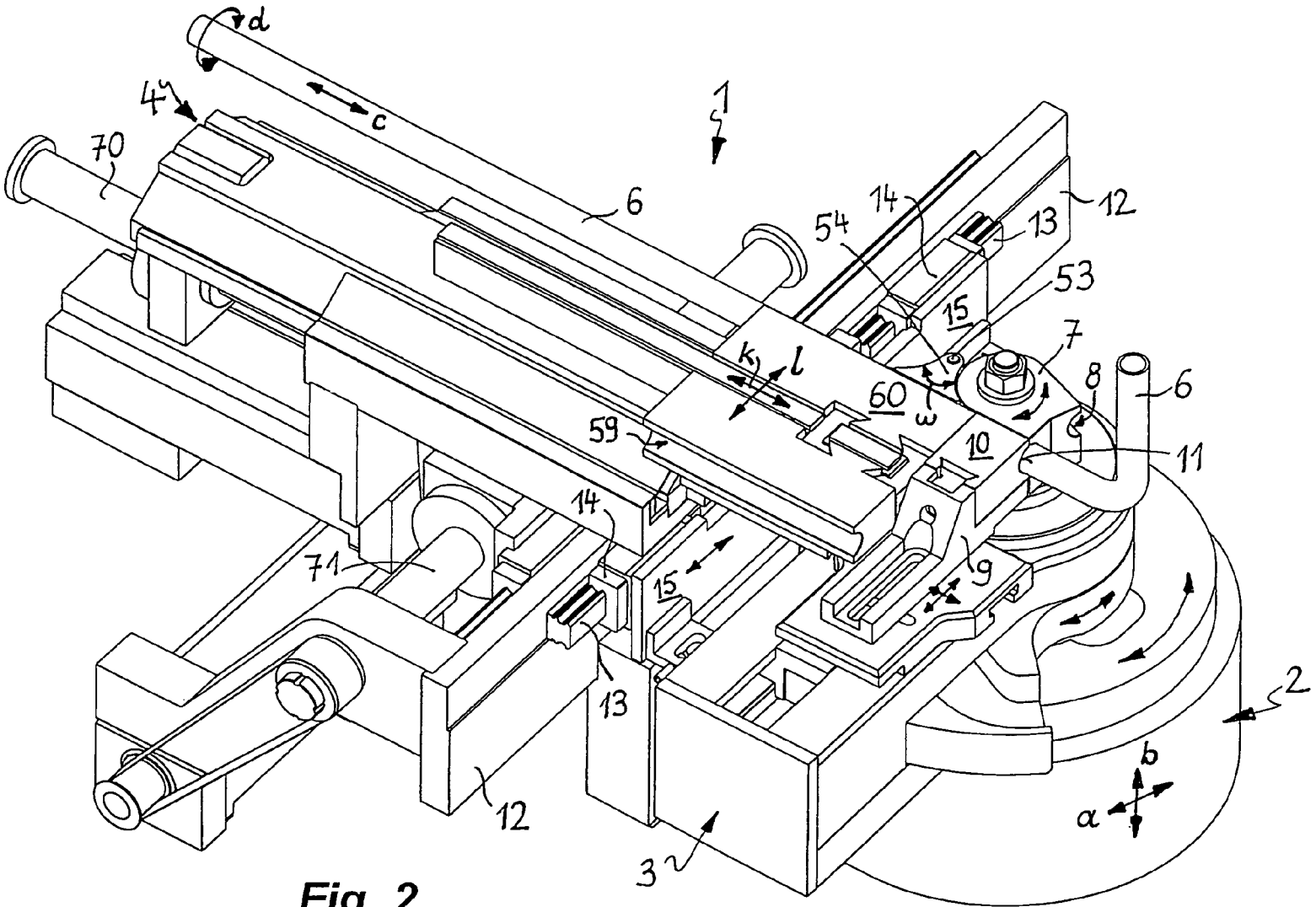
FIG. 2 shows an oblique perspective view of the apparatus of FIG. 1, but changed to left-hand bending.
Figure 3:
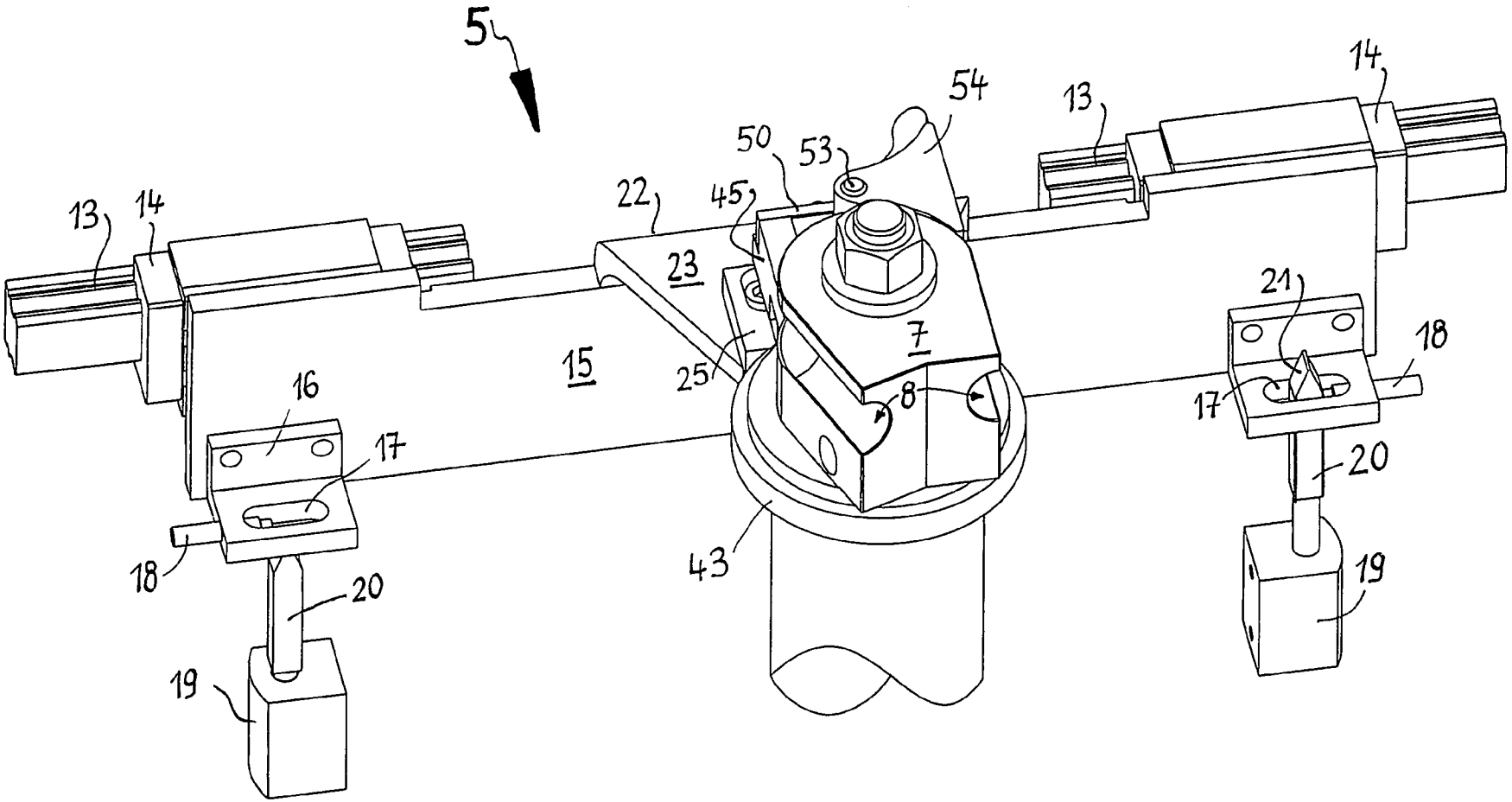
FIG. 3 shows an enlarged perspective detail view of the bending mandrel and a wrinkle smoothener arrangement according to the invention.

FIG. 1 shows (in an oblique, top front view) a perspective view of bending apparatus 1 shortly before execution of a right-hand bending operation, whereas FIG. 2 shows a similar oblique perspective view of the same bending apparatus 1, but in the starting condition prior to a left-hand bending operation.

As is evident from FIG. 1, the bending apparatus 1 substantially comprises three important devices, namely a bending head 2 (comprising a clamping device 3), further a sliding rail 4 (as a feeding device) and a wrinkle smoothener 5. These three devices serve to produce bends on prefabricated pipes or tubes 6, where a good shaping result is to be achieved without wrinkles or cracks forming on the tube 6.

The bending head 2 is movable as a whole on a horizontal path of movement a and on a vertical path of movement b by means of a suitable drive (not shown in the Figures, however).

The bending head 2 consists, first of all, of a carrier body 2, on top of which a bending mandrel 7 is arranged, said bending mandrel being rotatable about a central axis M. Arranged laterally on said mandrel is a tubular workpiece 6 (of relatively small wall thickness) in a forming groove 8, which is provided on the bending mandrel 7 and extends over three sides thereof, the shape of said groove being substantially adapted to the shape of the outer contour of the tube 6 facing towards it. The tube 6 is fed in the direction c by a feeding device (not shown in the Figures), from which it exits via clamping tongs (also not shown in the Figures), but by means of which it can be held position-locked in a certain position at any time. By means of the feeding device or the clamping tongs, respectively, it is also possible to rotate the tube 6 about its longitudinal axis in the direction of rotation d, i.e. in both directions.

While the tube 6 is being bent around the bending mandrel 7, the wrinkle smoothener 5 ensures that the tube 6 does not wrinkle (on the inside) or crack (on the outside) during bending.

The clamping device 3, including a clamping block 9, is assigned to the bending mandrel 7 laterally, said clamping block carrying an exchangeable clamping jaw 10 on its side facing towards the bending mandrel 7, in which clamping jaw, facing towards the tube 6 to be bent, a forming groove 11 of a shape and size corresponding to the side, facing towards it, of the outer contour of the tube 6 is provided.

A base plate 12 of the sliding rail 4 has arranged thereon, on its side facing towards the bending head 2, a pair of linear guide rails, one linear guide rail 13 each mounted on the left-hand side and on the right-hand side of the bending mandrel 7, respectively; FIG. 1 shows only the guide rail 13 on one side, whereas FIG. 2 shows the guide rails on both sides.

A carriage 14 is displaceably arranged on each linear guide rail 13. The carriages 14 of the pair of linear guide rails are connected to each other by a bridging plate 15, on which a flange 16 with an oblong hole 17 is provided. Threaded pins 18 are screwed into the front faces of the flange 16, by which pins a limitation of the effective length of the oblong hole 17 may be effected.

A cylinder 19 mounted to the bending head 2 can be introduced into the oblong holes 17 from below, the rod 20 of said cylinder being provided with a chamfer 21 at its end on the side being introduced. Thus, when extending the cylinder 19, the entire wrinkle smoothener 5 can be moved laterally on the pair of linear guide rails 13 due to the chamfered surface 21 at the end of the piston rod 20 of one of the two cylinders 19, while moving upwards, abutting laterally against the retracted end of the associated threaded pin 18 and pushing the retracted end outwards as its retraction progresses. Thus, in FIG. 1, the cylinder 19 shown in front therein is fully retracted, so that its upper chamfered surface 21 has been made to contact the associated end of the threaded pin 18 by pressure and has thereby displaced the bridge plate 15 towards the outside (thus, in FIG. 1: to the left).

In the position shown in FIG. 2, the other cylinder (not shown in FIG. 2, as it is not visible) is extended, while the cylinder 19 on the side that is located in front in the Figure is retracted, so that the bridge plate 15 is thereby shifted to the right as shown in the drawing.

The bridge plate 15 has arranged thereon a bar 22 having on its top surface a surface 23 which is angled towards the bending mandrel 7, with a groove 24 extending perpendicular to the bridge plate 15 in the middle of said surface.

On the top surface 23 of the bar 22 there is a flange 25 which comprises, at its center, an engaging bar 26 extending into the groove 24 for positioning. The flange 25 is mounted to the bar 22 by two screws 27 and comprises, at its end facing towards the bending mandrel 7, an upwardly extending setoff 28, to the top surface of which a slide block 40 is rotatably mounted by means of a screw 41 and a bushing 42.

Figure 4:
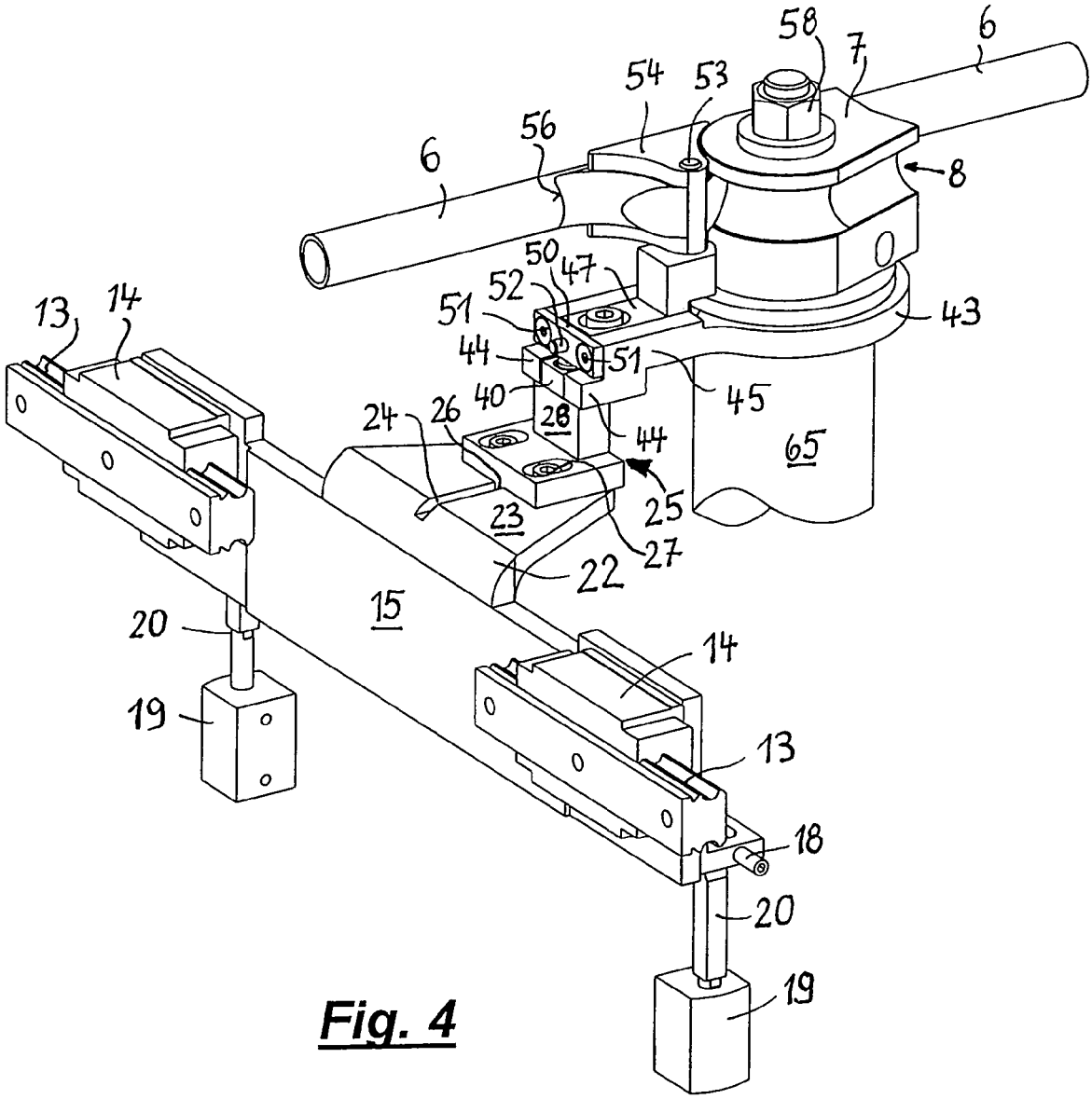
FIG. 4 shows a perspective view of the arrangement of FIG. 3, but from a different viewing direction.
Figure 6:
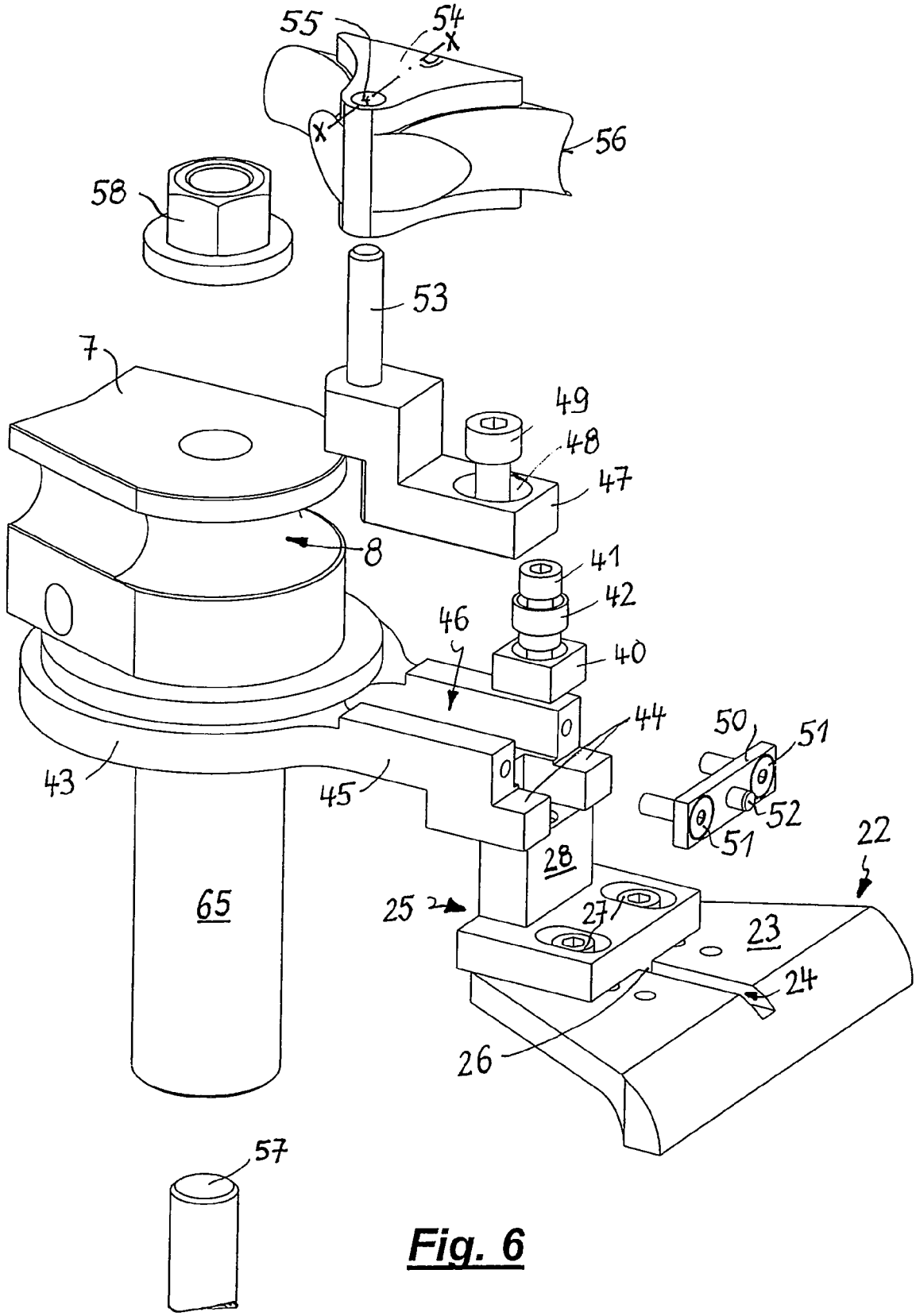
FIG. 6 shows an exploded perspective view of the arrangement of the bending mandrel and the wrinkle smoothener sliding jaws of FIG. 4 which precede it.

As is evident, in particular, from the illustration of FIG. 4 (showing an oblique perspective view of a detail of individual elements for better illustration thereof) as well as from the exploded view of FIG. 6, the slide block 40 is encompassed by a holding fork 44 at the end of a radially protruding portion 45 of the support ring 43.

On the upper side of this radially protruding portion 45 a radially directed longitudinal recess 46 is provided, which is directed towards the axis of rotation of the support ring 43 (and thus towards the bending mandrel 7).

Displaceably located within said recess 46 is a carrier block 47, having formed therein from its upper side a stepped bore 48 including an oblong hole, in which bore a bolt 49 is located which secures the carrier block 47 against being lifted out of the recession 46, while still allowing a relative displacement of the carrier block 47 within the boundaries of the oblong hole in a direction towards the bending mandrel 7 or away from it, respectively.

The recess 46 is closed at its radially protruding end by means of a cross plate 50, which is mounted on both sides of the recess 46 to a carrier block 47 by a screw 51 respectively and carries an adjusting screw 52 at its center, by means of which screw the carrier block 47 can be displaced within the recess 46 by suitably screwing it in.

A support axis 53 extends upwardly, in a direction parallel to the axis of roation of the bending mandrel 7, from the end portion of the carrier block 47 facing towards the bending mandrel 7. On the support axis 53, there is a sliding jaw 54 comprising a bore 55 into which the support axis 53 extends. The sliding jaw 54 is only arranged onto the support axis 53 such that it is freely rotatable thereon and also axially displaceable thereto. If desired, however, the inner diameter of the bore 55 can also be made slightly larger than the outer diameter of the support axis 53, so that the sliding jaw 54 can also effect a certain tilting movement, albeit a small one, relative to the support axis 53.

The sliding jaw 54 is provided, on its side facing towards the workpiece 6, with a forming groove 56 in the longitudinal direction thereof, which groove serves to contact the outer contour of the workpiece facing towards it and whose shape substantially complements the shape of said outer contour.

After setting the distance of the carrier block 47 from the bending mandrel 7, the former can be positionally fixed, if desired, from above by means of the screw bolt 49. On the other hand, the carrier block 47 may also be constantly biased by means of a biasing spring (not shown in the Figure) between it and the cross plate 50 in a direction towards the bending mandrel 7, which also permits continuous re-adjustment when wear occurs at the sliding jaw 54.

In this case, the overall shape of the sliding jaw 54 is such, as is well evident from FIG. 4, that when approaching the bending mandrel 7 it is adapted in shape to the bending groove 8 such that, when the end of the forming groove 56 facing towards the bending mandrel 7 makes contact within the bending groove 8, the forming groove 56 ensuring tangential introduction into the bending groove 8 of the bending mandrel 7, with the tube 6, which extends along the forming groove 56 of the sliding jaw 54, being introduced tangentially into the bending groove 8. FIG. 4 very clearly shows this mutual engagement of the end portion of the slide jaw 54 and the bending groove 8 of the bending mandrel 7, so that explicit reference is made to said drawing in this respect.

The exploded view of FIG. 6, which substantially shows the arrangement of FIG. 4 (albeit with a somewhat different orientation of the bending mandrel 7), very clearly illustrates the mounting of the bending mandrel 7:

The bending mandrel 7 is pulled into a receiving part (not shown) via a pull rod 57 and a nut 58, as a result of which flexure of the bending mandrel 7 during bending of a tube is reduced. This also makes it possible to effect a very rapid change of tool and to reduce the idle time of the machine during re-fitting. The set of tools, consisting of a bending mandrel holder 65, a support ring 43, a cross plate 50, a carrier block 47, the sliding jaw 54 and the bending mandrel 7, can then be jointly removed by loosening the nut 58 and can be replaced with a different set of tools. Thus, the setting operations can also be carried out outside of the machine. Setting the wrinkle smoothener 5 requires the following steps to be performed once:

The sliding jaw 54 is made to contact the corresponding side of the bending mandrel 7 by displacing the carrier block 47 in the recess 46 accordingly towards the bending mandrel 7. In order to achieve the tangential orientation and introduction of the forming groove 56 of the sliding jaw 54 relative to the bending groove 8 of the bending mandrel 7, lateral displacement of the plate 15 in the direction of the arrows (FIG. 1 and FIG. 4) is effected by extending the corresponding adjustment cylinder 19 by means of the corresponding threaded pin 18 and this movement is converted into a corresponding rotary movement of the support ring 43 via the bar 22, the flange 25, the side block 40 and the holding fork 44.

After this adjustment for the first side of the sliding jaw 54, the latter is pivoted through 180° about a support axis 53 and is made to contact the bending mandrel 7 on the other side. At the same time, the other of the two cylinders 19 is extended and is engaged with its associated oblong hole 17 and threaded pin 18.

Since the sliding jaw 54 has a design which is completely symmetrical to its central plane X-X (which extends through the central axis of its support axis 53 perpendicular to the longitudinal central line of its forming groove 56) (cf. the graphic illustration of the sliding jaw 54 in FIGS. 4 and 6), this second fine adjustment only requires adjustment of the precise rotational position of the support axis 53, i.e. of the exact position of the bridge plate 15, by the corresponding cylinder 19 and the associated adjusting screw 18 in order to achieve precise tangential orientation of the forming groove 56 of the sliding jaw 54 also on this other side of the bending mandrel 7, for tangential introduction of the workpiece 6 there into the bending groove 8 of the bending mandrel 7.

After this initial setting, the wrinkle smoothener 5 can then be integrated fully automatically into the operation of the bending apparatus 1.

In addition to the sliding jaw 54, the wrinkle smoothener 5 comprises a further sliding jaw 60 (cf. FIGS. 1 and 2) which, in the representation of FIGS. 1 and 2 is located opposite the sliding jaw 54 relative to the tube 6 and, when viewed from above, is designed as a rectangular block element having both of its longitudinal sides (one of which faces towards the tube 6) respectively provided with a longitudinal forming groove 59, whose shape is also (at least substantially) complementary to the outer contour, facing towards it, of the tube or workpiece 6. During operation of the bending apparatus, this sliding jaw 60 is also made to contact the tube 6, so that the tube 6 is encompassed there on both sides by the sliding jaws 54 and 60, and these prevent the occurrence of wrinkles (on the side of the sliding jaw 54) and cracks (on the side of the sliding jaw 60) when the tube passes through between them.

The sliding jaw 60 is adjustable relative to the sliding jaw 54 (perpendicular to the feeding direction of the tube 6) and is moved away from the tube 6, as is the clamping device 3, in the insertion position (not shown in the Figures) of the tube 6.

As FIG. 1 shows, the sliding rail 4 is mounted to the bending head 2 and contains two spindle drives 70 and 71, by which the sliding jaw 60 can be positioned in a plane. In doing so, the sliding rail 4 is always positioned on the side of the clamping block 9 with respect to the axis of the tube 6. During operation of the apparatus, the sliding jaw 60 contacts the tube 6 by its forming groove 59. Depending on the particular application, the sliding rail 4 has to perform different functions during the bending operation: Thus, for example, it follows the tube 6, pulls it back or feeds it, e.g. in order to avoid cracks forming in the raw material. In the illustrated exemplary embodiment of FIG. 1, the sliding rail 4 is also used to position a holding element on which the clamping block 9 is located, as well as to pivot the other sliding jaw 54 (about its support axis 53) when changing the bending direction.

As material for the two sliding jaws 54 and 60, a material is used which has good sliding properties, is at the same time wear-resistant and can bear great stress. An aluminum-bronze material which is commercially available under the name "Ampco" has turned out to be particularly suitable for this purpose.

FIG. 1 shows the starting position of the bending apparatus 1 for right-hand bending. The wrinkle smoothener 5 contacts the rear side of the bending mandrel 7A via the front portion of the sliding jaw 54. In this case, the rear cylinder 19 (hidden by the bending head 2 in FIG. 1) is also extended. In order to change to left-hand bending, after the tube 6 has been released by the clamping device 3 and the sliding jaw 60, and after the bending head 2 has been lowered vertically, the sliding rail 4 with the sliding jaw 60 moves back behind the pivotal point (support axis 53) in the direction of c, is then laterally displaced in the direction of a and thus pivots the sliding jaw 54 with the sliding jaw 60 (cf. representation of FIGS. 5A to 5E).

After the sliding rail 4 with the sliding jaw 60 has laterally passed the pivotal point, it is moved forward again in the direction of c and thereby places the sliding jaw 54 in contact with the other side of the bending mandrel 7. At the same time, the cylinder 19 (hidden in FIG. 1) retracts and the other cylinder 19 (visible in FIG. 1) extends. This optimally aligns the wrinkle smoothener and the forming groove 56 of the sliding jaw 54 with the bending mandrel 7, which has also been previously displaced together with the clamping device 3 into its suitable position for left-hand bending. Next, the bending head 2 is moved up from below, and, while the clamping device 3 and the clamping jaw 60 are open, the tube 6 is inserted into the forming groove 56 of the sliding jaw 54 and the bending groove 8. After that, the sliding jaw 60 as well as the clamping jaw 10 are made to contact the tube 6 laterally, thus achieving the starting position shown in FIG. 2 of the bending apparatus 1 for left-hand bending of the tube 6.

FIG. 2 shows the starting position of the bending apparatus (with the wrinkle smoothener 5) before left-hand bending is begun.

Finally, FIGS. 5A to 5E show, in a quite schematic representation, different operational phases during pivoting of the sliding jaws 54 and 60 of the wrinkle smoothener 5 from a starting position for right-hand bending up to a re-adjusted starting position for left-hand bending.

In the representations of FIGS. 5A to 5E individual relative positions of the sliding jaws 54 and 60 during re-adjustment and pivoting from a starting position for right-hand bending (FIG. 5A) to a starting position for left-hand bending (FIG. 5E) are shown, and for clearer illustration only a few important elements are shown in their positions relative to one another.

Figure 5A:
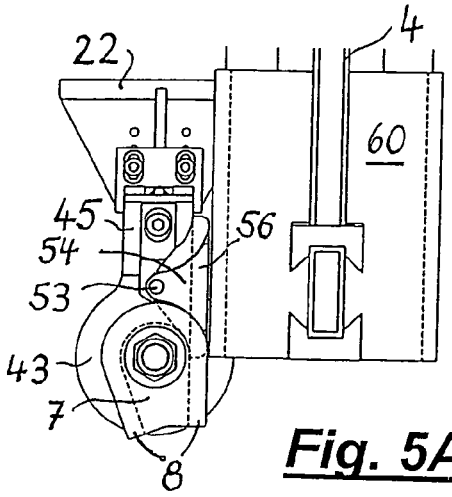
FIGS. 5A to 5E show a schematic representation of the operational phases during pivoting of a wrinkle smoothener according to the invention when changing the bending direction (top view)

FIG. 5A shows (a top view of) the bending mandrel 7 (with the bending groove 8 indicated in broken lines), the sliding jaw 60 as well as the sliding jaw 54 which is pivotable about the support axis 53, said sliding jaw 54 being guided in the radially protruding portion 45 of the support ring 43, the latter being slightly rotatable in the above-mentioned manner by the slide block 40 (not visible in FIGS. 5A to 5E) by a lateral movement of the bar 22.

In the starting position for right-hand bending according to FIG. 5A, the forming groove 56 (indicated in broken lines) of the sliding jaw 54 extends tangentially into the bending groove 8 (also indicated in broken lines) of the bending mandrel 7 and is in immediate contact therewith.

Figure 5B:
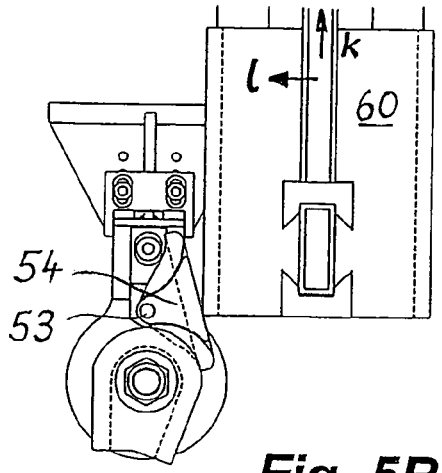

Now, if the apparatus is to be adapted to left-hand bending as shown in FIG. 5B, the bending mandrel 7 is first set to its new position for left-hand bending, while at the same time, the sliding jaw 60 is moved over the sliding rail 4 by actuating the drive 70, in the direction of the arrow k, parallel to the feeding direction of the workpiece or tube 6 (not shown in FIGS. 5A to 5E), until its front edge, which is at bottom left in the representation of FIG. 5B, has been displaced a little beyond the position of the support axis 53 (viewed in the direction of k). Then, during further displacement in the direction of k, the sliding jaw 60 is moved, in addition, perpendicular to its previous movement, in the direction of I by the drive 71, and, with its already mentioned lower front edge contacting the side of the sliding jaw 54 facing towards said edge, a rotation of said jaw is initiated in the direction of w. One such initial rotary position is shown in FIG. 5B.

Figure 5C:
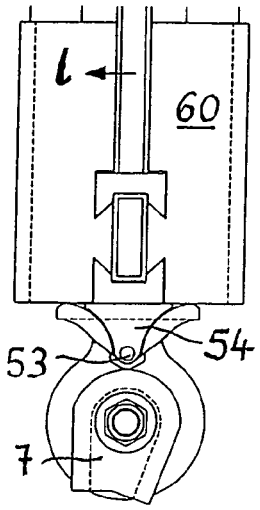
Figure 5D:
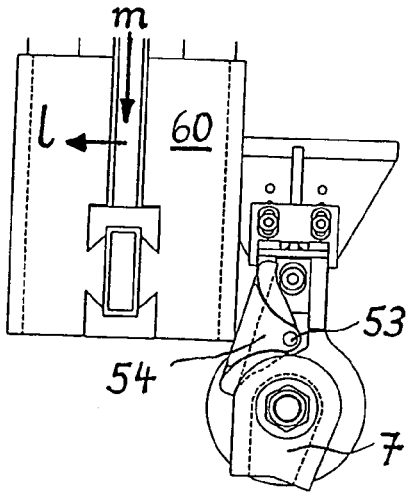

In FIG. 5C, a position has been reached in which the side of the sliding jaw 54 facing towards the sliding jaw 60 is directed perpendicular to the feeding direction of the workpiece 6, and the entire front side of the sliding jaw 60 facing towards it is in contact with it here. The sliding jaw 60 is now no longer displaced in the direction of k, but only in the direction of I along the front side of the sliding jaw 54, until its lower right front edge in FIG. 5C, when viewed in the direction of 1, has been moved beyond the position of the support axis 53. After this, the sliding jaw 60, while still moving in the direction of 1, is at the same time additionally displaced in the direction of m and, by its front edge located at bottom right in FIG. 5D still contacting the front side of the sliding jaw 54 facing towards it, tilts the latter further in the rotary direction of w, with FIG. 5D showing one such intermediate position.

Figure 5E:
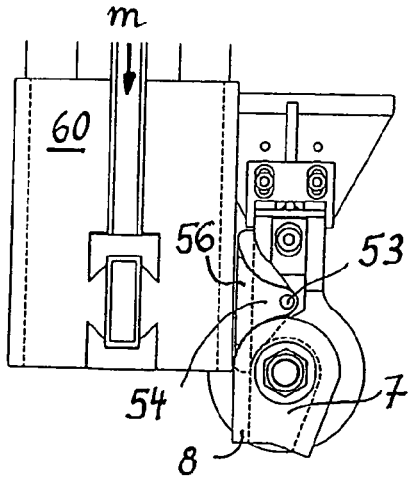

Finally, the end position shown in FIG. 5E is reached (as the starting position for left-hand bending), after the sliding jaw 60 has only been displaced in the direction of m into a position, which is mirror-inverted to the position of FIG. 5A (with respect to a mirror plane extending through the central axis of the bending mandrel 7 and parallel to the feeding direction of the workpiece 6). In the final position shown, the other sliding jaw 60 is also located in a mirror-inverted position relative to its position of FIG. 5A (with respect to the same mirror plane) and, with its end portion facing towards the bending mandrel 7, in turn contacts the bending groove 8 of the bending mandrel 7, the forming groove 56 of the sliding jaw 54 again being tangentially contiguous to the bending groove 8 there.

All movements effected during these re-adjustments are controlled by a program control (not shown in the Figures), the movements of the sliding jaw 60 being caused by the drives 70 and 71, while the rotary movement of the sliding jaw 54 is effected by cooperation with the moved sliding jaw 60 (as a result of the free rotatability of the sliding jaw 54 about the support axis 53).

The invention claimed is:

1. A bending apparatus for rod-shaped and tubular workpieces, said apparatus comprising:

a displaceable bending head having arranged thereon a rotatable bending mandrel with a bending groove for contact with the workpiece to be bent and a clamping device, which is displaceable relative to the bending mandrel and concentrically rotatable relative thereto, for clamping the workpiece between said clamping device and said bending mandrel, and said apparatus comprising a feeding device for the workpiece;

the bending apparatus being adapted for both right-hand bending and left-hand bending of the workpiece around the bending mandrel, and wherein the workpiece can be made to contact the bending mandrel on one side thereof in a predetermined bending direction and on the other side thereof when changing the bending direction;

wherein the bending head also comprises a wrinkle smoothener, which, when viewed in the feeding direction of the workpiece, immediately precedes the bending mandrel and comprises two sliding jaws between which the workpiece may be located and wherein each sliding jaw defines, on a side facing towards the workpiece, a first forming groove that is substantially complementary to an outer contour of the workpiece, and wherein the groove can be made to contact the workpiece;

one sliding jaw being displaceable relative to the other sliding jaw in a direction substantially perpendicular to the feeding direction of the workpiece and both sliding jaws and the clamping device being displaceable and/or rotatable, from one side of the bending mandrel to another side of the bending mandrel for changing the bending direction around the bending mandrel into a corresponding arrangement which is substantially mirror image inverted relative to a plane that extends substantially through an axis of rotation of the bending mandrel and substantially parallel to the feeding direction of the workpiece; and wherein the sliding jaw on the side of the bending mandrel is substantially freely rotatable on a support axis extending substantially parallel to the axis of rotation of the bending mandrel and the support axis is shiftable relative to the bending mandrel, towards it and away from it, substantially parallel to the feeding direction of the workpiece, said sliding jaw being arranged such that it can contact the bending groove of the bending mandrel by shifting the support axis towards the bending mandrel with the end of the sliding jaw's forming groove facing towards the bending mandrel, such that the forming groove is substantially tangentially contiguous to the bending groove of the bending mandrel.

2. The bending apparatus as claimed in claim 1, wherein the two sliding jaws comprise a first sliding jaw and a second sliding jaw and the first sliding jaw is displaceable towards and away from the second sliding jaw and is located on the same side of the workpiece as the clamping device.

3. The bending apparatus as claimed in claim 1, further comprising a control, by which the displacement and/or rotary movements required to change the bending direction are initiated only after the bending head has been lowered far enough for the elements to be located below the workpiece clamped by the bending apparatus.

4. The bending apparatus as claimed in claim 1, wherein the support axis is displaceable on a support ring, which in turn is located on a shaft of the bending mandrel and rotatable relative thereto.

5. The bending apparatus as claimed in claim 4, wherein the support ring comprises a radially protruding portion on which the support axis is displaceably supported and which forms at its protruding end portion a holding fork, which is radially outwardly open and receives a slide block, which is in turn rotatable on a holding device which is movable substantially perpendicular to the feeding direction of the workpiece.

6. The bending apparatus as claimed in claim 5, wherein the support axis is arranged on a carrier block, which is in turn displaceable in a radially outwardly extending guiding groove of the radially protruding portion of the support ring, said groove being above the holding fork, wherein said guiding groove is closed at its radially outward end by a cross bar, in which an adjusting screw is arranged, said screw engaging the carrier block and being positionally adjustable within the guiding groove.

7. The bending apparatus as claimed in claim 5 wherein the holding device comprises a supporting bridge, which is held on the bending head and is displaceable relative thereto on substantially linear rails.

8. The bending apparatus as claimed in claim 1 wherein the sliding jaw located on the side of the clamping device comprises, on its side located opposite the first forming groove, a second forming groove which is substantially mirror-symmetrically arranged relative to said first forming groove with respect to a longitudinal central plane of said sliding jaw, said plane extending substantially parallel to the workpiece feeding device and to the axis of rotation of the bending mandrel.

9. The bending apparatus as claimed in claim 8, wherein said sliding jaw is displaceable to the other side of the bending mandrel such that it can be made to contact the workpiece by its second forming groove.

10. The bending apparatus as claimed in claim 9, wherein the sliding jaw on the side of the clamping device is connected to a drive unit, by which it is displaceable both substantially parallel to the feeding direction of the workpiece and in a direction substantially perpendicular thereto, to the other side of the bending mandrel.

11. The bending apparatus as claimed in claim 1, wherein the sliding jaws are arranged on a common carrier plate, on which the sliding jaw located on the same side of the workpiece as the clamping device is shiftable both in a substantially vertical direction towards the forming groove of the other sliding jaw and substantially parallel thereto, wherein, in order to change the bending direction, said carrier plate with the sliding jaws carried by it is pivotable about an axis of rotation that is substantially parallel to the axis of rotation of the bending mandrel and which is located in a plane extending substantially through the axis of rotation of the bending mandrel and substantially parallel to the feeding direction of the workpiece.

12. The bending apparatus as claimed in claim 1, wherein the sliding jaw which is located on the support axis is continuously biased so as to contact the bending groove of the bending mandrel.

13. A wrinkle smoothener arrangement for a bending apparatus for a rod-shaped or tubular workpiece, comprising a bending mandrel having a bending groove, said bending mandrel being adapted for both right-hand bending and left-hand bending, said wrinkle smoothener arrangement comprising:

two sliding jaws for bilateral contact with the workpiece, each of the sliding jaws defining a forming groove for contact with the workpiece and one sliding jaw being displaceable relative to the other sliding jaw, and both sliding jaws being displaceable and/or rotatable, in order to change the bending direction around the bending mandrel of the bending apparatus, to an arrangement of their forming grooves which are mirror-inverted to a plane extending substantially through the axis of rotation of the bending mandrel and substantially parallel to the feeding direction of the workpiece, wherein the sliding jaw, which is arranged on the side of the bending mandrel, is substantially freely rotatable on a support axis which is substantially parallel to the axis of rotation of the bending mandrel, said support axis having coupled to it an adjustment device by which the sliding jaw's position is shiftable until the sliding jaw contacts the bending mandrel and away from the bending mandrel, said sliding jaw and its forming groove being arranged such that, when viewed in the longitudinal direction of the forming groove, if each of the sliding jaw's end portions are facing towards the bending mandrel, the sliding jaw and its forming groove can be made to contact the bending mandrel such that said end portion of its forming groove is tangentially contiguous to the bending groove of the bending mandrel.

* * * * *